US006467843B1

(12) United States Patent
Rossborough

(10) Patent No.: US 6,467,843 B1
(45) Date of Patent: Oct. 22, 2002

(54) COLLAPSIBLE SEAT

(75) Inventor: W. Neil Rossborough, Naples, FL (US)

(73) Assignee: EZ Seat, Inc., Naples, FL (US)

( * ) Notice: Subject to any disclaimer, the term of this patent is extended or adjusted under 35 U.S.C. 154(b) by 0 days.

(21) Appl. No.: 09/556,005

(22) Filed: Apr. 20, 2000

(51) Int. Cl.[7] ..... A47C 3/29; A47B 9/00

(52) U.S. Cl. ..... 297/344.18; 297/338; 248/161; 108/34; 108/150

(58) Field of Search ..... 297/344.19, 338, 297/344.18; 108/150, 34; 248/161, 405

(56) References Cited

U.S. PATENT DOCUMENTS

| | | | | | |
|---|---|---|---|---|---|
| 2,523,817 | A | * | 9/1950 | Conley et al. | 108/150 X |
| 2,568,534 | A | * | 9/1951 | Baker | 108/150 X |
| 2,720,249 | A | | 10/1955 | Peterson | |
| 2,742,955 | A | | 4/1956 | Dominguez | |
| 3,176,676 | A | * | 4/1965 | Caldwell | 108/150 |
| 3,283,733 | A | | 11/1966 | Boerma | |
| 3,467,033 | A | | 9/1969 | Sienkiewicz et al. | |
| 4,085,686 | A | | 4/1978 | Turner et al. | |
| D261,450 | S | | 10/1981 | Jenkins | |
| D265,025 | S | | 6/1982 | Nichols et al. | |
| 4,833,999 | A | * | 5/1989 | Rhodes | 108/150 X |
| 4,951,996 | A | | 8/1990 | Shannon | |
| 5,188,424 | A | | 2/1993 | Herron | |
| D382,426 | S | | 8/1997 | Frederick | |
| 5,975,635 | A | * | 11/1999 | Parpala | 297/338 |

* cited by examiner

*Primary Examiner*—Anthony D. Barfield
(74) *Attorney, Agent, or Firm*—Vickers, Daniels & Young

(57) ABSTRACT

A collapsible seat having a human support position when in an assembled condition and a transportable condition. The collapsible seat includes a seating member and a base member that are both substantially identical wherein the seat member and the base member are removably interengaged by a telescopic pedestal. When in the assembled condition, the pedestal is in at least one extended position and a top end of the pedestal is rigidly connected to the seat member while the bottom end of the pedestal is rigidly connected to the base member. When in the transportable condition, the pedestal is in a retracted position and is separate from the seat member and the base member and can be stored between the seat member and the base member.

14 Claims, 4 Drawing Sheets

COLLAPSIBLE SEAT

BACKGROUND OF THE INVENTION

The present inventions directed to a collapsible seat and, more particularly, to a collapsible seat that is easily transportable and can be used on all types of ground surfaces.

It is well known that seats can be folded or collapsed to make them more transportable. While in a collapsed condition, the seat is typically easier to carry and takes up less space. As a result, seats can be utilized in many locations. However, unlike a chair used within a home, a collapsible seat can encounter a wide range of ground surfaces. These ground surfaces can range from the very soft to the very hard and from smooth to varying degrees of textures. The wide range of ground surfaces restricts use of many seats and often results in collapsible seats being designed for a particular use or one type of ground surface. The present invention is a collapsible seat that can be effectively utilized on a wide range of ground surfaces and that has additional advantages that will be discussed below.

The prior art relating to collapsible seats includes Parpala U.S. Pat. No. 5,975,635 which discloses a portable seat that is designed for use on soft ground. In order to overcome the difficulties associated with soft ground surfaces, which often causes instability, Parpala utilizes a pedestal that penetrates the ground deep enough to reach more stable subsoils. Once the pedestal has reached stable soil, an upper tube, which is permanently fixed to the seat portion, interengages with the pedestal to support and stabilize the seat. While the seat of Parpala '635 is portable and can be used in connection with soft ground surfaces, the seat is not fully collapsible and is intended for use in connection with soft ground surfaces. Furthermore, the penetration of the pedestal which is required to use the seat damages the ground.

Turner et al U.S. Pat. No. 4,085,686 and Jenkins D261, 450 also disclose portable seats designed for use with soft ground surfaces. The Turner and Jenkins seats utilize tubular portions that are similar to Parpala in that they are intended to penetrate soft ground surfaces. However, these seats further include flange portions that restrict the penetration of the tubular portion and stabilize the seat attached thereto. As with Parpala, the seat portions disclosed in Turner and Jenkins are permanently attached to the pedestal portions, thereby reducing the collapsibility of the seats. The collapsibility of Jenkins' seat is further limited in that the seat portion is permanently attached to the penetrating portion of the pedestal.

Boerma U.S. Pat. No. 3,283,733 discloses a portable seat wherein the top portion of the pedestal includes a projection that is selectively receivable in a recess located in the bottom surface of the seating portion, but cannot be rigidly connected thereto when in the assembled condition. As a result, the seat portion can be removed; however the stability of the seat is reduced and the ability to move the seat is inhibited. In this respect, the horizontal planer structure of the seat portion is easy to grasp and pull upwardly while grasping a pedestal requires considerable wrist force to keep the hands from merely sliding up the pedestal when an upward force is applied. Accordingly, Boerma's seat requires additional effort to remove the seat from the ground before it is collapsed. In addition, the seat is still not fully collapsible. in that the pedestal is a unitary component that must be long enough to both extend into the ground to stabilize the seat and extend above the ground to produce the seating height. As with the seats discussed above, Boerma's seat is designed for use in connection with soft ground. As a result, Boerma's seat is only partially collapsible and is not fully transportable.

Even though the seat structures discussed above can be considered portable, they are not fully collapsible, they are not easily transportable and they can not be used on all ground surfaces. Another disadvantage is that the pedestal portions must penetrate the ground surface to stabilize the seat thereby damaging the ground by producing a hole therein. Accordingly, these seat structures are not versatile and are not suitable in connection with many activities such as sports activities including golf, soccer and other field sports.

Herron U.S. Pat. No. 5,188,424 discloses a portable seat that can be used in connection with a baseball bat or other elongated objects. With respect to the baseball bat, the occupant of the seat is not able to fully relax in that the occupant must maintain balance resulting from the off-center position of his or her weight in relation to the supporting baseball bat. Even though the seat portion is removable from the baseball bat, both objects are required for use of the seat and, therefore, both must be transported individually or together in the assembled condition. Accordingly, Herron's seat cannot be considered fully collapsible. Furthermore, if Herron's seat is used in connection with an independent elongated member, the portability of the seat is limited to the position of the elongated member.

Sienkiewicz et al U.S. Pat. No. 3,467,033 discloses a folding stool that is more collapsible than the seats described above; however, the seat is not fully collapsible and has other disadvantages. As with the seats discussed above, the base design of Sienkiewicz's seat is hot well suited for all ground surfaces. In this respect, for example, tines are required to stabilize the stool if it is used in connection with soft ground. Furthermore, the seat portion and the base portion are permanently affixed to the pedestal portion thereby reducing the collapsibility of the seat. To allow the seat portion to collapse against the pedestal, the pedestal is able to move relative to the seat portion; however, this requires a complicated tubular sleeve structure to connect the seat portion to the pedestal. More particularly, the sleeve allows rotation of the seat portion about the end of the pedestal and subsequently allows axial displacement of the seat portion relative to the pedestal once the pedestal is generally parallel with the bottom surface of the seat portion. However, the seat portion remains connected to the pedestal. In addition, the base portion remains fixed to the pedestal even when the seat is in the transportable condition.

The portable seats in the prior art discussed above have many disadvantageous. One such disadvantage is that the seats are not fully collapsible into a compact package for easy transportation thereof. Furthermore, some of the prior art seats require complicated mechanical structures to allow for only partial collapsing of the seat. Another disadvantage is that the seats disclosed in the prior art are not compatible with all ground surfaces. In fact, many of the disclosed seats are designed for use in connection with only one type of ground surface. These seats also leave behind large holes in the ground after they have been removed. Even the seats that are not intended to penetrate the ground for stability can inadvertently penetrate and damage the ground as a result of the small contact area of the base portion of the seat. This feature fails to disperse the weight of the occupant over an adequate area of ground surface and, therefore these seats are not appropriate for many soft ground surfaces often associated with outdoor use such as at sporting events.

SUMMARY OF THE INVENTION

The present invention advantageously provides an improved collapsible seat which can be used on all types of ground surfaces and minimizes damage to the ground surface by dispersing the weight of the occupant over a large area. Furthermore, a seat according to the present invention can be fully collapsed into a compact package and can be manufactured using light weight materials for easy transportation thereof. In this respect, a collapsible seat is provided which comprises a telescopic pedestal that is selectively received on one end by a seat portion and on the opposite end by a base portion. The seat portion and the base portion are substantially similar in shape to produce a shell-like arrangement enclosing the pedestal when the seat is in the collapsed condition. Furthermore, the seat portion and the base portion include a large seating surface and bottom surface respectively so that the seat can both comfortably support an occupant and be used in connection with virtually all types of ground surfaces.

It is therefore an outstanding object of the present invention to provide an improved collapsible seat which can be collapsed into a compact package for easy transportation thereof.

It is yet another object of the present invention to provide an improved collapsible seat that can be used on all types of ground surfaces.

Still another object of the present invention is to provide a collapsible seat which is easy to manufacture.

Yet still another object of the present invention is to provide a collapsible seat that is easy to use by the end user.

Another object of the present invention is to provide a collapsible seat that is easily adjustable in height to allow use by persons of varied sizes.

Still yet another object of the present invention is to provide a collapsible seat that can be easily carried.

Yet still another object of the present invention is to provide a collapsible seat that minimizes the damage to the ground surface that supports the seat.

Still another object of the present invention is to provide a collapsible seat that is light weight yet sturdy enough to support a human occupant.

BRIEF DESCRIPTION OF THE DRAWINGS

The foregoing objects, and others, will in part be obvious and in part point out more fully hereinafter in conjunction with the written description of a preferred embodiment of the invention illustrated in the accompanying drawings in which.

DESCRIPTION OF THE PREFERRED EMBODIMENT

Figure 1:
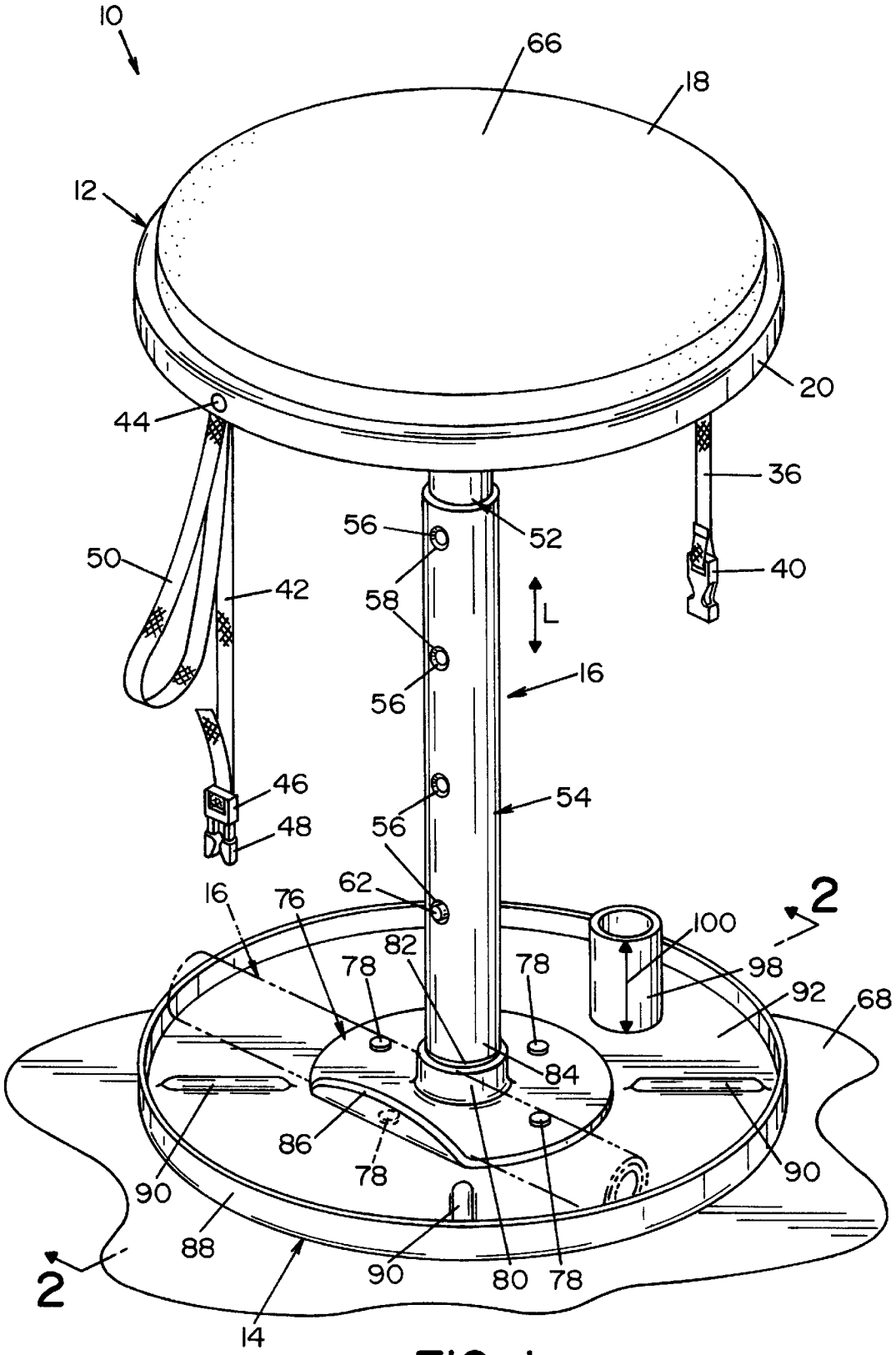
FIG. 1 is a perspective view of a collapsible seat in the assembled condition in accordance with the present invention.
Figure 2:
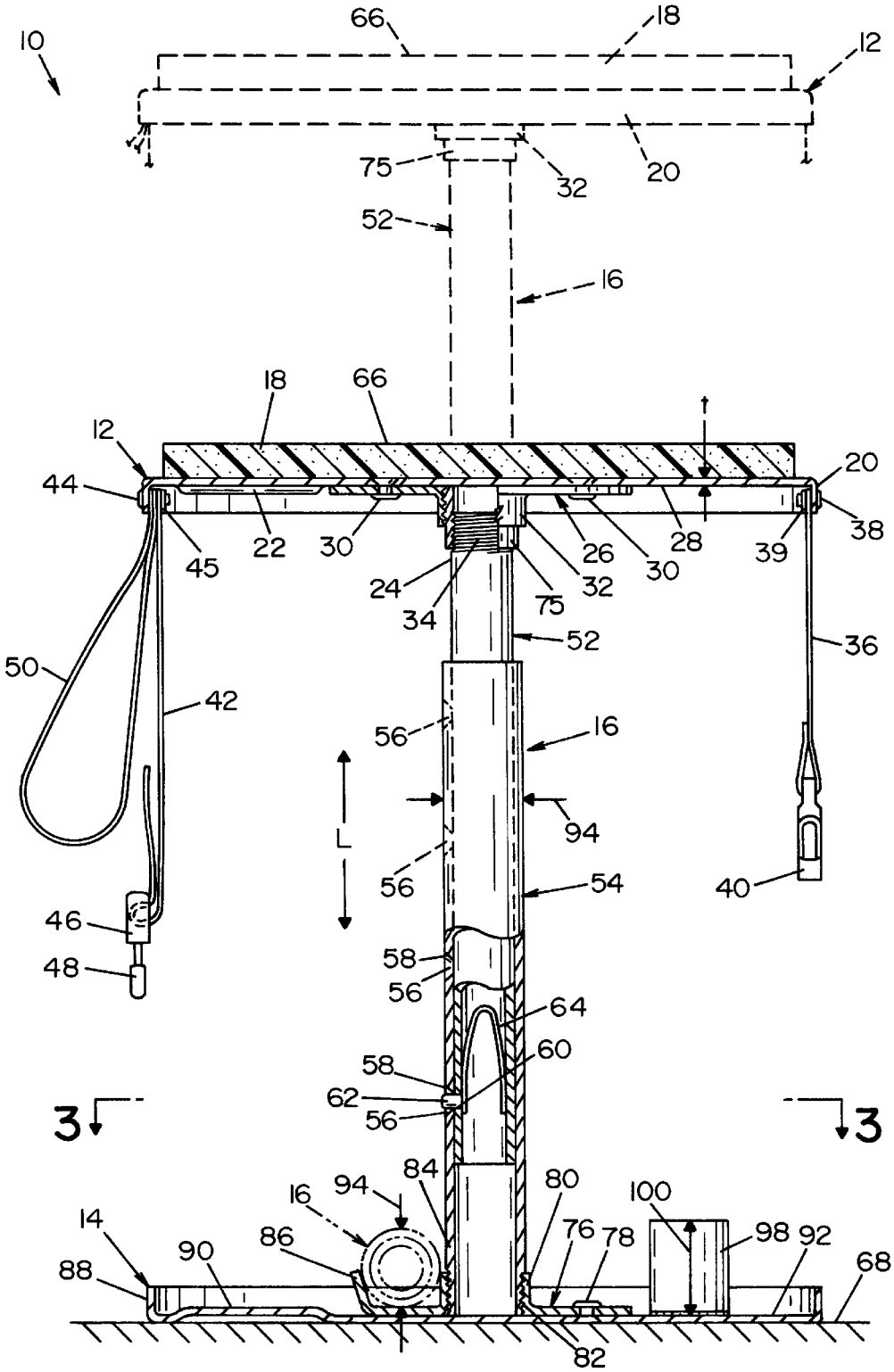
FIG. 2 is a partial cross-sectional elevational view taken along line 2—2 in FIG. 1.

Referring now in greater detail to the drawings wherein the showings are for the purpose of illustrating a preferred embodiment of the invention only, and not for the purpose of limiting the invention, a collapsible seat 10 according to the present invention is illustrated in FIGS. 1 and 2 in a human supporting or assembled condition. Seat 10 includes a seat member 12, a base member 14 and a telescopically expandable and collapsible pedestal 16. Seat member 12 is large enough to comfortably support a human occupant and includes a foam cushion 18 to enhance comfort by resiliently supporting the occupant's weight. Seat member 12 can be manufactured from thin and lightweight material having a thickness t by incorporating seat flange 20 and a plurality of seat ribs 22. Seat member 12 is joined to top end 24 of pedestal 16 by way of a mounting flange 26. Flange 26 is permanently affixed to lower portion 28 of seat member 12 by a plurality of rivets 30. It should be noted that flange 26 could be attached to seat member 12 using other methods such as by welding, adhesives, threaded fasteners or other joining methods. Flange 26 includes an internally threaded neck portion 32 which removably receives an externally threaded portion 34 on top end 24 of pedestal 16. The threaded engagement between flange 26 and top end 24 of pedestal 16 allows for quick and easy selective engagement between pedestal 16 and seat member 12 and also provides for a strong, stable joint therebetween when in the assembled condition.

Seat member 12 further includes a first strap 36 which has one end permanently connected to seat flange 20 by a rivet 38 and a washer 39. The opposite end of first strap 36 includes a plastic strap clip 40. On the diametrically opposite side of seat member 12 is a second strap 42 which also has one of its ends permanently connected to seat flange 20 by a rivet 44 and a washer 45. The opposite end of second strap 42 includes an adjustable mating strap clip 46 having extending portions 48 designed to be selectively received in strap clip 40 to hold first strap 36 and second strap 42 together. As will be discussed below with respect to the collapsed or transportable condition of the seat, first strap 36 and second strap 42 are utilized to maintain seat 10 in the collapsed condition. Rivet 44 and washer 45 also permanently affix a lanyard 50 to seat flange 20 which can be used to carry the collapsed seat.

Pedestal 16 is telescopic and preferably includes an inner elongated member 52 and an outer elongated member 54. Pedestal 16 could include more telescopic members depending on the desired amount of adjustability and compactness desired for the collapsed seat. As shown and described herein, inner member 52 and outer member 54 have a circular cross-sectional shape, but other mating cross-sectional shapes can be utilized. Pedestal 16 is therefore adjustable axially to allow pedestal 16 to be transformed from a retracted position to multiple extended positions depending on the desired seating height of the occupant. In this respect, outer member 54 includes multiple adjustment holes 56 spaced apart therealong and which all have a beveled edge portion 58. Inner member 52 includes a hole 60 which receives a pin 62 utilized to selectively lock inner member 52 to outer member 54 and to change the overall length L of pedestal 16. In this respect, pin 62 is maintained in hole 60 by a leaf spring 64 until the pin lines up with one of the holes 56 in outer member 54 by the movement of outer member 54 relative to inner member 52. Once pin 62 is in alignment with one of the holes 56, the pin is urged through hole 56 thereby locking inner member 52 to outer member 54.

In FIGS. 1 and 2, seat 10 in the solid line position thereof is in its lowermost position with pin 62 penetrating the lowermost hole 56. However, length L of pedestal 16 can be adjusted to change the seating height, such as to that shown by the broken line position of the seat, and which height is defined by the distance between seating surface 66 and ground surface 68, by urging pin 62 inwardly until it is no longer within hole 56 and then moving inner elongated member 52 upwardly relative to outer elongated member 54 until pin 62 is in alignment with the hole 56 which provides the desired height. Beveled edges 58 facilitates the inward movement of pin 62 by allowing the partial penetration of the occupant's finger within hole 56. The seating height is then maintained by the interengagement between pin 62, hole 60 and the selected one of the plurality of hole 56. In the same fashion, pedestal 16 can be fully retracted to position the seat as shown in FIG. 1.

Figure 3:
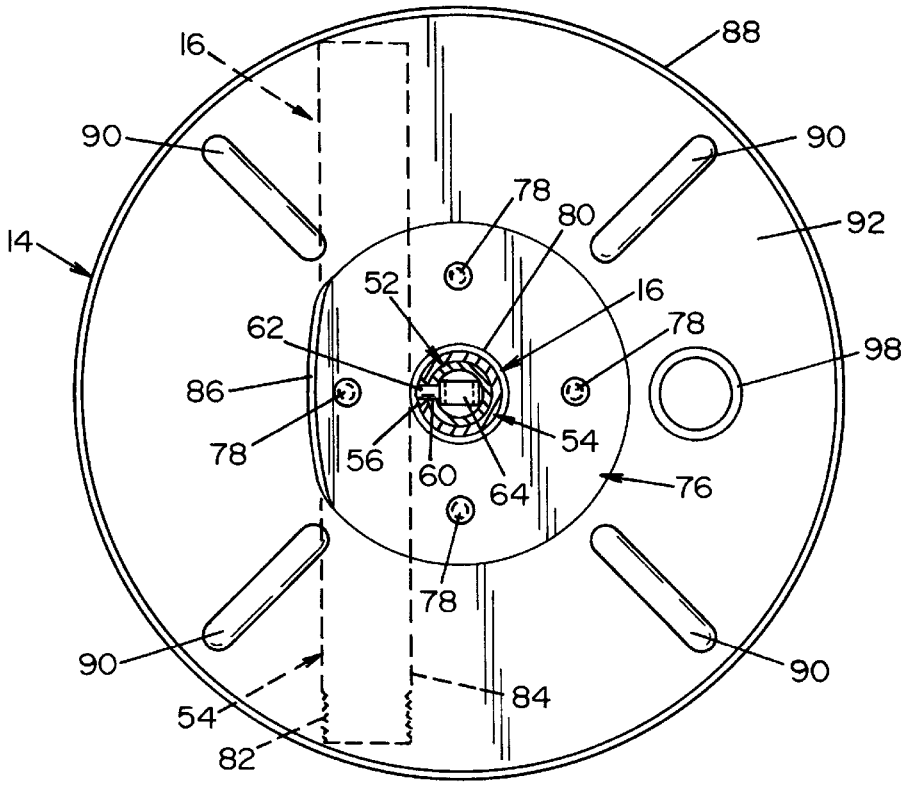
FIG. 3 is a cross-sectional view, taken along lines 3—3 in FIG. 2.

As best seen in FIGS. 2 and 3, pedestal 16 is also removably interengaged with base member 14 by way of a bottom flange 76. It is preferred that bottom flange 76 is identical to top flange 26 in most respects to reduce manufacturing costs; however, this is not an essential feature. If the flanges are identical, a spacer 75 can be used with flange 26 to account for the different outer diameters of inner and outer elongated members 52 and 54. Lower flange 76 is permanently affixed to base member 14 by rivets 78. As with upper flange 26, welding, adhesives or other fasteners known in the art could be utilized. Lower flange 76 includes an internally threaded neck portion 80 which is removably interengageable with an externally threaded portion 82 on bottom end 84 of pedestal 16. As discussed above, the threaded engagement between pedestal 16 and base member 14 produces a rigid connection therebetween when in the assembled condition and also facilitates quick and easy disassembly so that seat 10 can be readily collapsed and transported. To further facilitate the storage of pedestal and transportability of seat 10, lower flange 76 is modified with respect to upper threaded flange 26 to provide a lip portion 86 which helps retain pedestal 16 when the seat is in the collapsed condition. This feature will be discussed in more detail hereinafter with respect to the transportable or collapsed condition. Conversely, upper flange 26 could be modified instead of lower threaded flange 76 to include lip portion 86. In order to minimize costs while allowing for base member 14 to utilize thin and lightweight materials and to produce a shell-like arrangement with seat member 12, as explained hereinafter, base member 14 is structurally identical to seat member 12 and thus includes base flange 88 and a plurality of base ribs 90.

Figure 4:
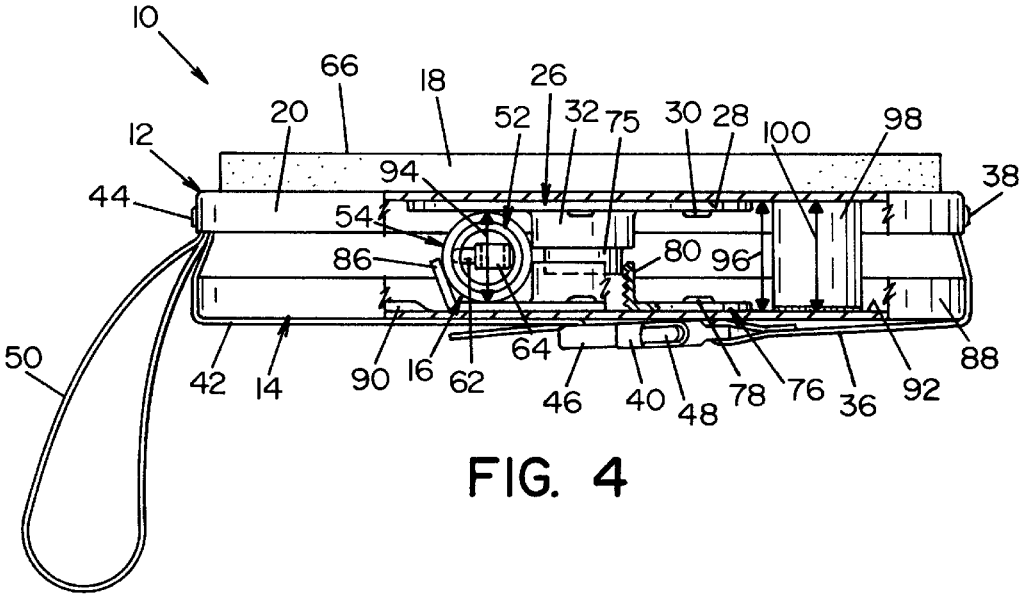
FIG. 4 is an elevation view partially sectioned of the collapsible seat in the collapsed condition.
Figure 5:
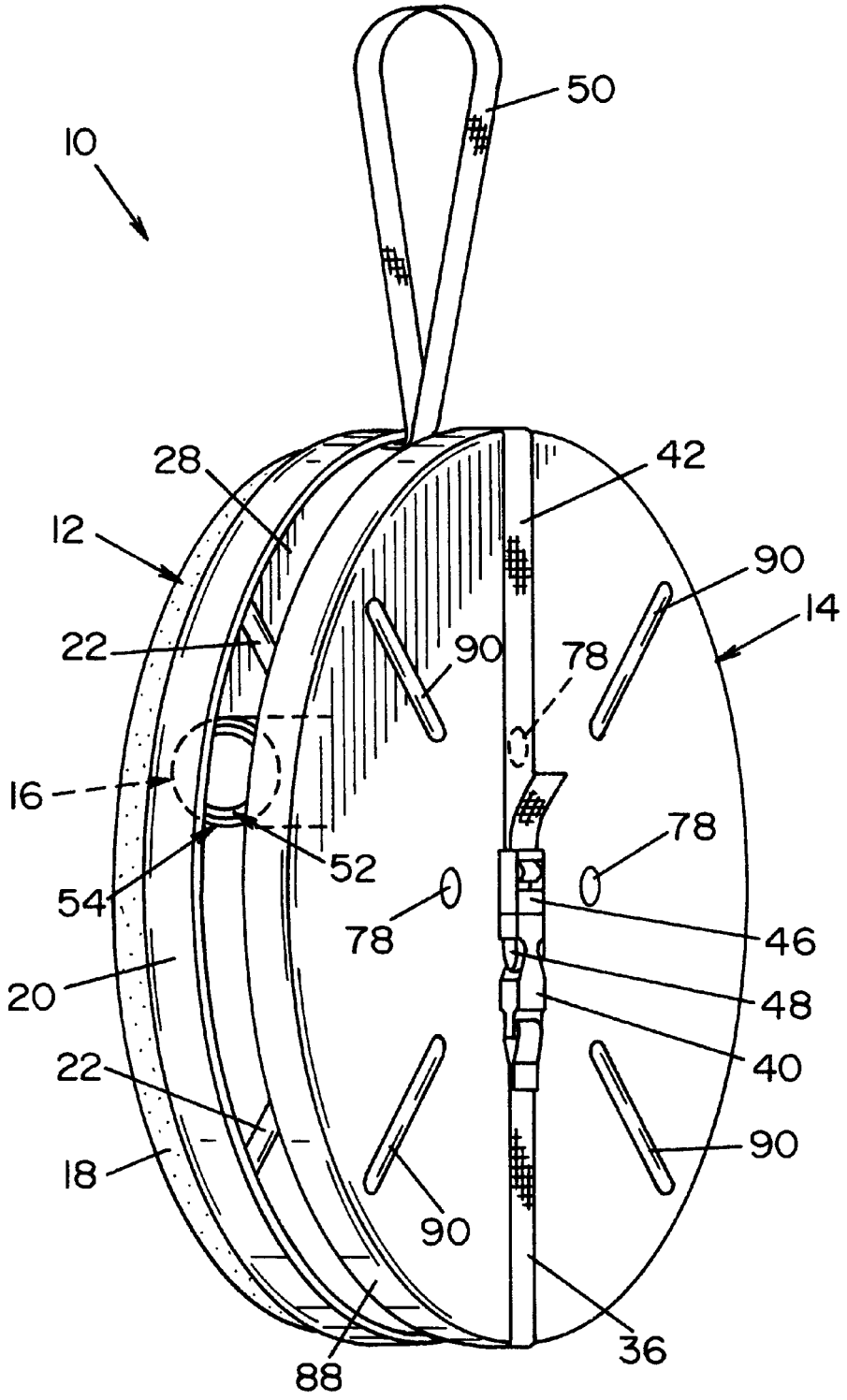
FIG. 5 is a perspective view of the collapsible seat in the collapsed condition for transportation.

Referring to FIGS. 4 and 5, seat 10 is shown in the collapsed or transportable condition. Transforming the collapsible seat 10 from the assembled condition to the collapsed condition begins with removing seat member 12 and base member 14 from pedestal 16. This involves rotating the seat and base members relative to the pedestal thereby disengaging the threads of the respective flange necks from the threaded ends of the pedestal. Referring to FIG. 3, pedestal 16 is then completely collapsed into its retracted condition and, as shown in FIGS. 1—4, is positioned on flange 76 of base member 14 and is maintained relative to base member 14 by its engagement between base flange 88 and between lip portion 86 and neck portion 80 of flange 76. Subsequently, seat member 12 is positioned such that lower portion 28 of seat member 12 is adjacent but spaced from upper portion 92 of base member 14 forming gap 96. Retracted pedestal 16 is prevented from movement relative to seat member 12 by its engagement with upper flange 26, upper seat flange 20, and lip portion 86 of lower flange 76. Accordingly, retracted pedestal 16 is conveniently stored between seat and base portions 12 and 14 for transporting the collapsed seat.

Pedestal 16 has an outer diameter 94 which produces gap 96, discussed above, between lower portion 28 of seat member 12 and upper portion 92 of base member 14. To compensate for gap 96 which is on one side of flange necks 32 and 80 and to provide rigidity for the collapsed seat, a spacer 98 is permanently affixed to upper portion 92 of base member 14 and has a length 100 which corresponds with gap 96. Spacer engages lower portion 28 of upper member 12 when the seat is in the collapsed condition, thereby minimizing the relative motion between seat member 12 and base member 14. It will be appreciated, of course, that spacer 98 could be provided on seat member 12 rather than base member 14.

Referring to FIG. 4, seat 10 is maintained in the collapsed condition by the interengagement between first strap 36 and second strap 42, discussed above, which are. connected to seat flange 20. This is facilitated by the locking engagement of strap clip 40 with the extending portions 48 of mating strap clip 46. More particularly, first strap 36 is connected on one of its ends to seat flange 20 and its other end is wrapped around base flange 88 and then under base member 14 toward second strap 42 which is diametrically opposed to first strap 36. Second strap 42 which is also connected on one of its ends to seat flange 20, is wrapped around base flange 88 and then under base member 14 toward first strap 36 and then strap clip 40 and mating strap clip 46 are then connected thereby securing seat member 12 to base member 14. To further reduce relative movement between seat and base members 12 and 14, the connection between first and second straps 36 and 42 can be tightened by the adjustability between second strap 42 and mating strap clip 46.

Referring to FIG. 5, seat 10, which is shown in the collapsed condition, can be easily carried by way of lanyard 50. By utilizing seat member 12 which is essentially equal in size and shape to base member 14, a collapsible seat is provided which has many advantages. These advantages include a compact and rigid collapsed condition which is easily transported and stored. Furthermore, a well-defined inner space is formed between the seat and base members which can conveniently be utilized to store the pedestal and other objects. Manufacturing costs are reduced by utilizing multiple, common components. In addition, the configuration of the components of seat facilitate the use of lightweight materials. Accordingly, a collapsible seat is produced that can be collapsed into a very small and lightweight transportable condition, yet the seat is sturdy and comfortable for the occupant thereof and can be used in connection with all types of ground surfaces because of the substantial flat base member.

While considerable emphasis has been placed on a preferred embodiment of the invention illustrated and described herein, it will be appreciated that other embodiments can be made and that many changes can be made in the preferred embodiment without departing from the principles of the invention. In this respect, for example, seat and base members 12 and 14 can be molded and upper flange 26 and lower flange 76 respectively can be molded into these respective components. This and other modifications will be obvious and suggested from the disclosure herein. Accordingly, it is to be distinctly understood that the foregoing descriptive matter is to be interpreted merely as illustrative of the invention and not as a limitation.

Having thus described the invention, it is claimed:

1. A collapsible seat having an assembled condition and a transportable condition, said seat comprising:

a seat member having an upper seating surface, a peripheral seat edge, and a lower side that includes a first connector;

a base member including a peripheral base edge and a bottom surface extending substantially to said peripheral base edge and an upper side that includes a second connector;

a telescopic pedestal including a top end, a bottom end, and slidably interengaged outer and inner members, said pedestal having a retracted position and at least one extended position; said top end of said pedestal including first connection means for removable interengagement with said first connector and said bottom end of said pedestal including second connection means for removable interengagement with said second connector;

said first connector being connected to said first connection means, said second connector being connected to said second connection means and said pedestal being in said at least one extended position when said seat is in said assembled condition;

said peripheral edges of said seat member and said base member being adjacent one another, and said pedestal being in said retracted position separate from said first and second connectors, when said seat is in said transportable condition and said inner and outer members have circular cross-sections, said first and second connection means are external threads on said top and bottom ends, and said first and second connectors are internally threaded.

2. A collapsible seat having an assembled condition and a transportable condition, said seat comprising:

a seat member having an upper seating surface, a peripheral seat edge, and a lower side that includes a first connector;

a base member including a peripheral base edge and a bottom surface extending substantially to said peripheral base edge and an upper side that includes a second connector;

a telescopic pedestal including a top end, a bottom end, and slidably interengaged outer and inner members, said pedestal having a retracted position and at least one extended position; said top end of said pedestal including first connection means for removable interengagement with said first connector and said bottom end of said pedestal including second connection means for removable interengagement with said second connector;

said first connector being connected to said first connection means, said second connector being connected to said second connection means and said pedestal being in said at least one extended position when said seat is in said assembled condition;

said peripheral edges of said seat member and said base member being adjacent one another, and said pedestal being in said retracted position separate from said first and second connectors, when said seat is in said transportable condition, at least one of said upper side and said lower side includes a retainer for said pedestal, and said pedestal is between said upper and said lower side and is held in place by said retainer when said seat is in said transportable condition, and said outer member has an outer diameter and at least one of said base members and said seat member includes a spacer between said upper and lower sides approximately equal to said outer diameter.

3. The seat of claim 2, wherein said seat member and said base member are circular, and each said seat edge and base edge is a peripheral flange, said inner and outer members have circular cross-sections, said first and second connection means are external threads on said top and bottom ends, and said first and second connectors are internally threaded.

4. The seat of claim 2, wherein said seat member and said base member are circular, and each said seat edge and base edge is a peripheral flange, and said seating surface includes a cushioned portion.

5. The seat of claim 4, wherein said cushion portion is foam rubber material.

6. The seat of claim 2, wherein said seat member and said base member are circular, each said seat edge and base edge is a peripheral flange, and said peripheral flanges extend toward one another, and said pedestal is held in place by said retainer and said peripheral flanges when in said transportable condition.

7. The seat of claim 6, wherein said outer member has an outer diameter and at least one of said base members and said seat member includes a spacer between said upper and lower sides approximately equal to said outer diameter.

8. A collapsible seat having an assembled condition and a transportable condition, said seat comprising:

a seat member having an upper seating surface, a peripheral seat edge and a lower side that includes a first connector;

a base member having an upper side that includes a second connector, a peripheral base edge, and a bottom surface extending substantially to said peripheral base edge;

a pedestal having a top end, a bottom end, a retracted position and at least one extended position, said top end of said pedestal including first connection means for removable interengagement with said first connector and said bottom end of said pedestal including second connection means for removable interengagement with said second connector;

said first connector being connected to said first connection means, said second connector being connected to said second connection means and said pedestal being in said at least one extended position when said seat is in said assembled condition;

said pedestal being in said retracted position and separate from said first and second connectors when said seat is in said transportable condition;

said pedestal is telescopic and includes an outer member and an inner member slidably engageable with said outer member; and, said inner and outer members have circular cross-sections, said first and second connection means are external threads, and said first and second connectors are internal threads.

9. The seat of claims 8, wherein said peripheral flanges extend toward one another and at least one of said upper and lower sides includes a retainer for said pedestal, said pedestal being held in place by said retainer and said peripheral flanges when in said transportable condition.

10. The seat of claim 9, wherein said outer member has an outer diameter and at least one of said base members and said seat member includes a spacer approximately equal to said outer diameter.

11. A collapsible seat having an assembled condition and a transportable condition, said seat comprising:

a seat member having an upper seating surface, a peripheral seat edge and a lower side that includes a first connector;

a base member having an upper side that includes a second connector, a peripheral base edge, and a bottom surface extending substantially to said peripheral base edge;

a pedestal having a top end, a bottom end, a retracted position and at least one extended position, said top end of said pedestal including first connection means for removable interengagement with said first connector and said bottom end of said pedestal including second connection means for removable interengagement with said second connector;

said first connector being connected to said first connection means, said second connector being connected to said second connection means and said pedestal being in said at least one extended position when said seat is in said assembled condition;

said pedestal being in said retracted position and separate from said first and second connectors when said seat is in said transportable condition;

said peripheral flanges extend toward one another and at least one of said upper and lower sides includes a retainer for said pedestal, said pedestal being held in place by said retainer and said peripheral flanges when in said transportable condition; and, said outer elongated member has an outer diameter and at least one of said base members and said seat member includes a spacer approximately equal to said outer diameter.

12. The seat of claim 11, wherein said seat member and said base member are circular.

13. The seat of claim 12, wherein said seat further includes a strap and a lanyard such that said strap maintains said seat in said transportable condition and said lanyard facilitating the transportation of said seat in said transportable condition.

14. The seat of claim 13, wherein said seat member is generally the same size and shape as the base member.

* * * * *